United States Patent [19]

Lang et al.

[11] Patent Number: 4,686,873

[45] Date of Patent: Aug. 18, 1987

[54] CASING TONG ASSEMBLY

[75] Inventors: David M. Lang, South Milwaukee; Richard W. Lewitzke, Franklin, both of Wis.

[73] Assignee: Becor Western Inc., South Milwaukee, Wis.

[21] Appl. No.: 935,159

[22] Filed: Nov. 25, 1986

Related U.S. Application Data

[63] Continuation of Ser. No. 764,553, Aug. 12, 1985, abandoned.

[51] Int. Cl.[4] ..... B25B 13/50

[52] U.S. Cl. ..... 81/57.35; 414/22; 166/77.5

[58] Field of Search ..... 81/57.35, 57.24, 57.25, 81/57.4, 57.15–57.17, 57.33; 414/22, 745, 744 A; 166/85, 77.5; 175/161, 85, 52; 901/15, 27, 28; 403/92–93, 98, 337, 109, 378, 379, 164

[56] References Cited

U.S. PATENT DOCUMENTS

| | | | |
|---|---|---|---|
| 2,147,002 | 2/1939 | Volpin | 255/35 |
| 2,546,224 | 3/1951 | Johansen | 255/35 |
| 2,871,743 | 2/1958 | Kelley | 81/53 |
| 3,177,944 | 6/1960 | Knights | 166/77.5 |
| 3,316,783 | 2/1965 | Wilson | 81/54 |
| 3,500,708 | 5/1967 | Wilson | 81/57.34 |
| 3,545,313 | 10/1969 | Kelley | 81/57.34 |
| 3,734,208 | 5/1973 | Otto | 175/52 |
| 3,780,815 | 12/1973 | Barron et al. | 173/43 |
| 3,799,009 | 3/1974 | Guier | 81/57.16 |
| 3,821,498 | 6/1974 | Schaefer, Jr. et al. | 414/744 A |
| 3,881,375 | 5/1975 | Kelly | 81/57.35 |
| 4,015,827 | 4/1977 | Brand | 403/379 X |
| 4,023,449 | 5/1977 | Boyadjieff | 81/57.16 |
| 4,283,165 | 8/1981 | Vertut | 901/15 X |

*Primary Examiner*—Frederick R. Schmidt
*Assistant Examiner*—Debra S. Meislin
*Attorney, Agent, or Firm*—Quarles & Brady

[57] ABSTRACT

An adjustable casing tong apparatus with a pivoting arm for disconnecting sections of drill string pipe in a drilling apparatus so that the casing tong can match the angle of the drill pipe used during angle drilling. A support column is connected to the deck of the drilling apparatus and an arm member is supported by the support column for movement in a direction along the longitudinal axis of the support column and is also rotatably connected to the column. A wrist member is pivotally and rotatably connected to the arm member and adjustable therewith by a pin indexing arrangement. A bracket hand is also pivotally connected to the wrist member. By suitable longitudinal adjustment of the arm member on the support column as well as the pin indexing arrangement between the wrist member and the arm member as well as rotation of the wrist member, the casing tong can suitably match the angle of the drill pipe used when angle hole as well as vertical drilling on a blast hole drill.

15 Claims, 11 Drawing Figures

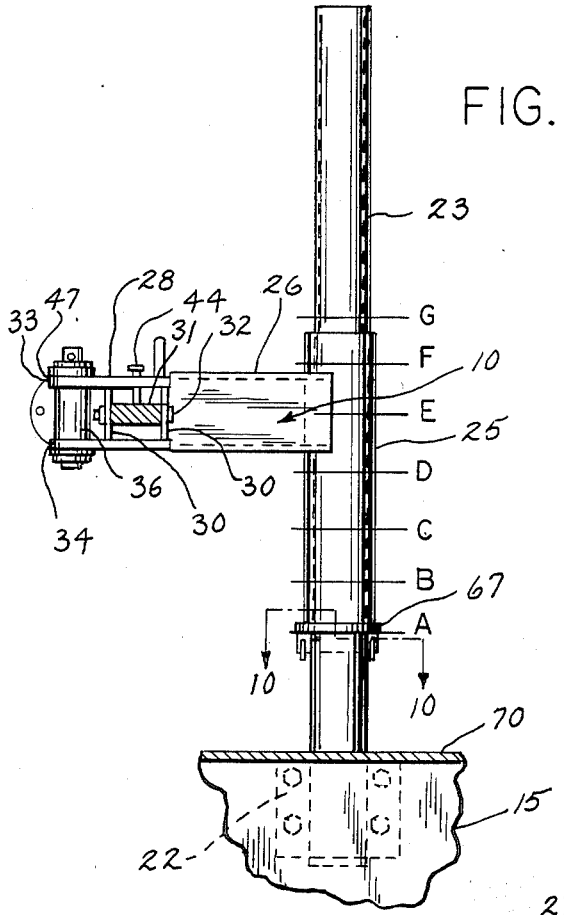
FIG. 3
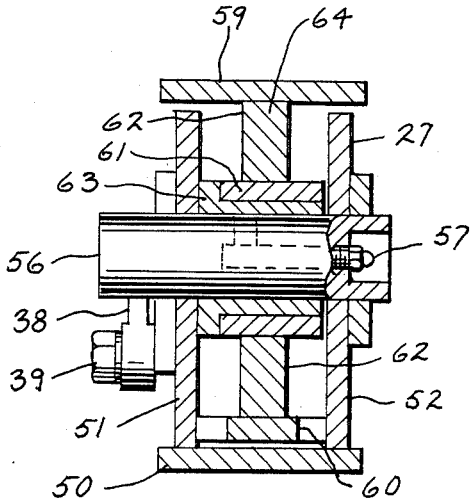
FIG. 6
FIG. 4
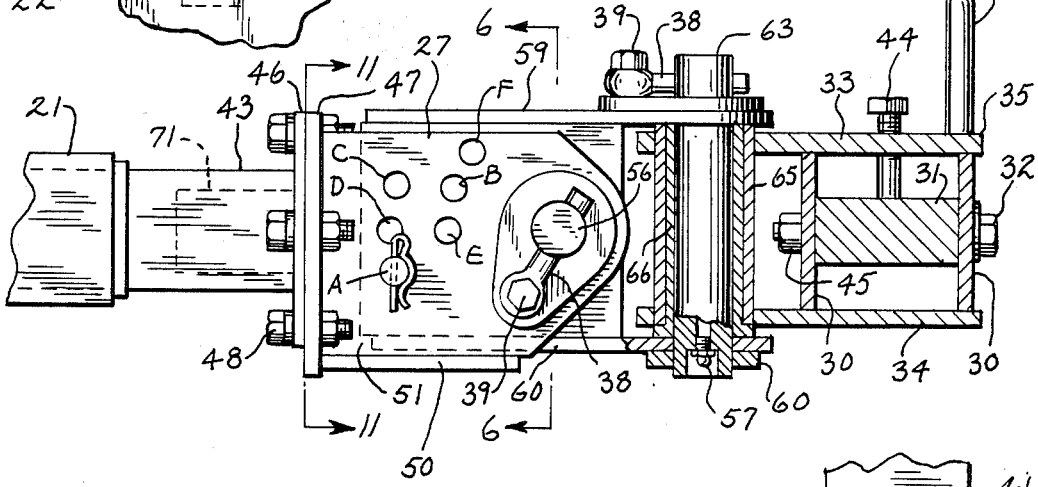
FIG. 5
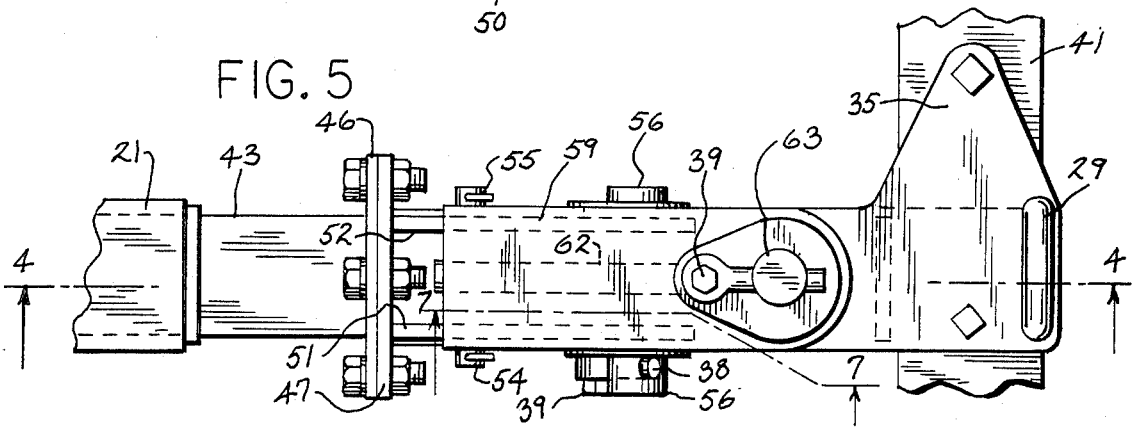

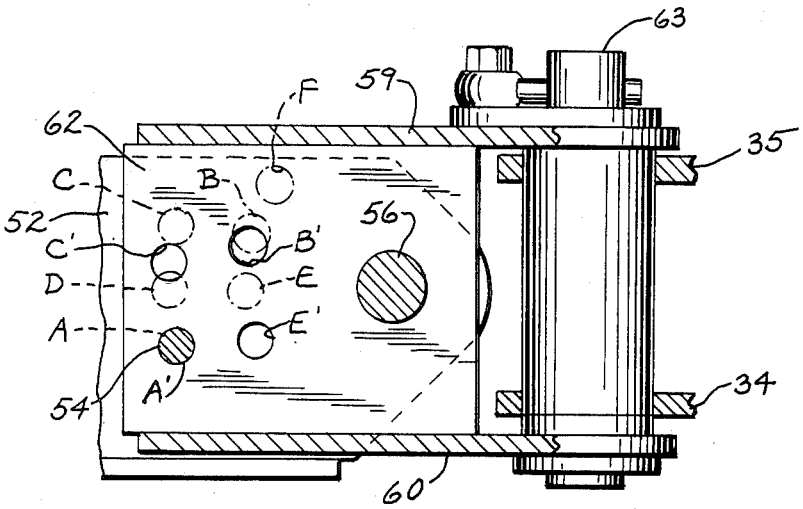
FIG. 7
FIG. 8
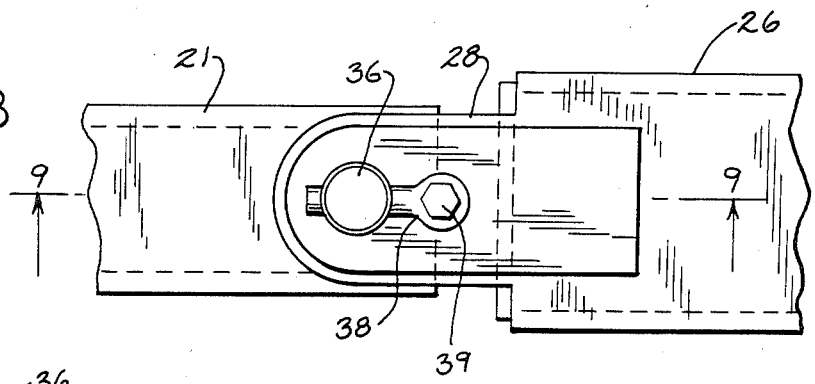
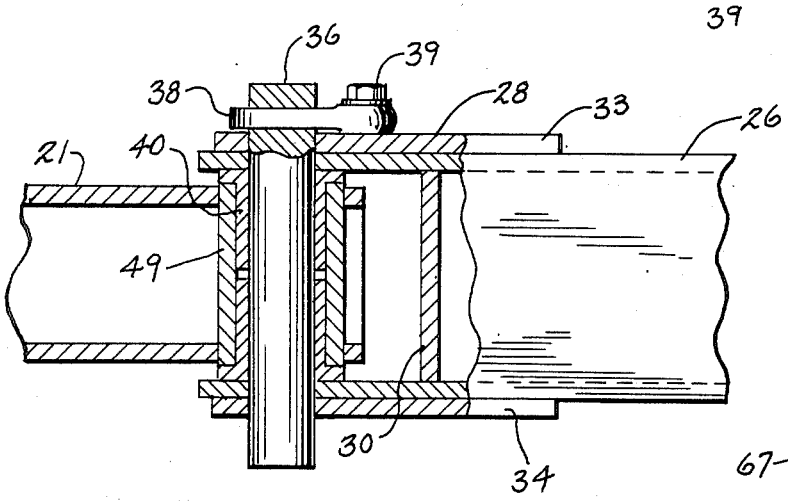
FIG. 9
FIG. 10
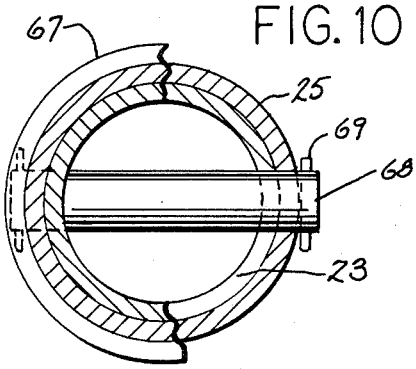
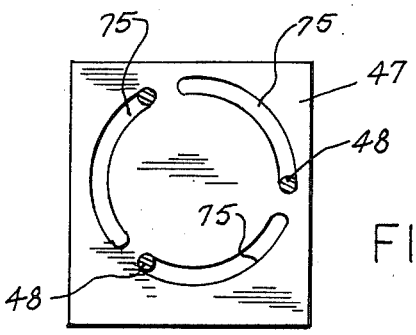
FIG. 11

CASING TONG ASSEMBLY

This application is a continuation of application Ser. No. 764,553, filed Aug. 12, 1985, now abandoned.

BACKGROUND OF THE INVENTION

This invention relates to rotary drilling apparatus and more particularly to a casing tong used in disconnecting a drill pipe from the drill string or from the drill bit. More particularly, this invention relates to an adjustable casing tong assembly and pivoting arm for disassembling sections of pipe in a manner such that the casing tong can match the angle of the pipe when positioned at an angle for angle hole drilling purposes.

The pivoting of pipe tong devices when handling drill pipes as well as their rotation is known. For example, U.S. Pat. No. 2,871,743 of Kelley shows heads 30 and 30*a* which can be rotated 180° by means of moving a latch pin 32. Pivoting is afforded through a wrist pin 45 supported on a pedestal structure 10. A racking mechanism is described in U.S Pat. No. 3,177,944 of Knights which has boom type arms 61 and 67 to provide support for tongs 72 which are actuated by a hydraulic jack 85. U.S. Pat. Nos. 3,316,783 and 3,500,708 issued to Wilson show power actuated tongs with multiple arm and pivotal actuation members. U.S. Pat. No. 3,780,815 of Barron shows a vertically disposed column 10 with a power tong assembly 26 supported by a yoke structure 24 which extends from the support collar 20 for movement up and down the column.

The prior art does not address the problem of angle drilling wherein pipe must be handled for breakout purposes at an angle with respect to the mast when the mast is positioned for angle drilling. Specifically, the prior art does not provide multiple adjustments for a casing tong which not only is adjustable along the support column but also includes pin indexing means for matching the angle of the drill pipe.

It is an advantage of the present invention to provide a casing tong which is adjustable to match the angle of the drill pipe during angle drilling.

It is another advantage of this invention to provide a casing tong of the previously described type which is especially adapted for use with blast hole drills.

Still another advantage of this invention is to provide a casing tong of the foregoing type which not only is adjustable along a vertical support column but also includes pin indexing means for further adjustment purposes.

Yet another advantage of this invention is to provide a casing tong for use when the drill pipe and mast are at an angle but will allow the operator to stand on a level deck surface rather than the angled surface of the mast structure.

Other advantages are an adjustable casing tong which can be manufactured from readily available components and utilized by an operator with a minimum of effort.

SUMMARY OF THE INVENTION

The foregoing advantages are accomplished and the shortcomings of the prior art are overcome by the present adjustable casing tong assembly with a pivoting arm which can hold sections of a drill string of pipe, when drill pipe and mast are at an angle. A support column is connected to the drilling apparatus and an arm member is supported by the support column for movement in the direction along the longitudinal axis of this support column as well as for rotatable movement with respect to the column. A wrist member is connected to the arm member at one end and to a gripping tong means at the other. Pin indexing means is operatively associated with the arm member and the wrist member to provide a pivoting and rotation of the wrist member with respect to the arm member and in different positions to have the gripping tong means match the angle of the tilting mast and drill pipe. In the preferred embodiment, the pin indexing means is arranged to provide pivotal and rotational adjustment of the wrist member so as to match a mast or drill pipe angle in the range of 0° to about 30°. Also preferably, the casing tong assembly will have a tong means including a bracket hand member pivotally connected to the wrist member and gripping tongs. Also in the preferred manner, the arm member is formed by two arm portions with the arm portions being pivotally connected to each other. In one embodiment of the invention, the arm member is supported on the support column by a pin support means.

BRIEF DESCRIPTION OF THE DRAWINGS

A better understanding of the casing tong assembly of this invention will be accomplished by reference to the drawings wherein:

FIG. 3 is a view in side elevation of the casing tong assembly as attached to the side of the fixed blast hole drill deck.

FIG. 4 is an enlarged view in partial vertical section illustrating the attachment of the bracket hand and bracket wrist member to the casing tong pivoting arm.

FIG. 5 is a top. plan view of the bracket wrist and bracket hand shown in FIG. 4.

FIG. 6 is a view in vertical section taken along line 6—6 of FIG. 4.

FIG. 7 is a view in vertical section taken along line 7—7 of FIG. 5

FIG. 8 is a partial and enlarged view of the attachment between two of the arm sections of the casing tong assembly.

FIG 9 is a view of vertical section taken along line 9—9 of FIG. 8.

FIG. 10 is a view in horizontal section taken along line 10—10 of FIG. 3.

FIG. 11 is a view in vertical section taken along line 11—11 of FIG. 4.

DESCRIPTION OF THE PREFERRED EMBODIMENT

Figure 1:
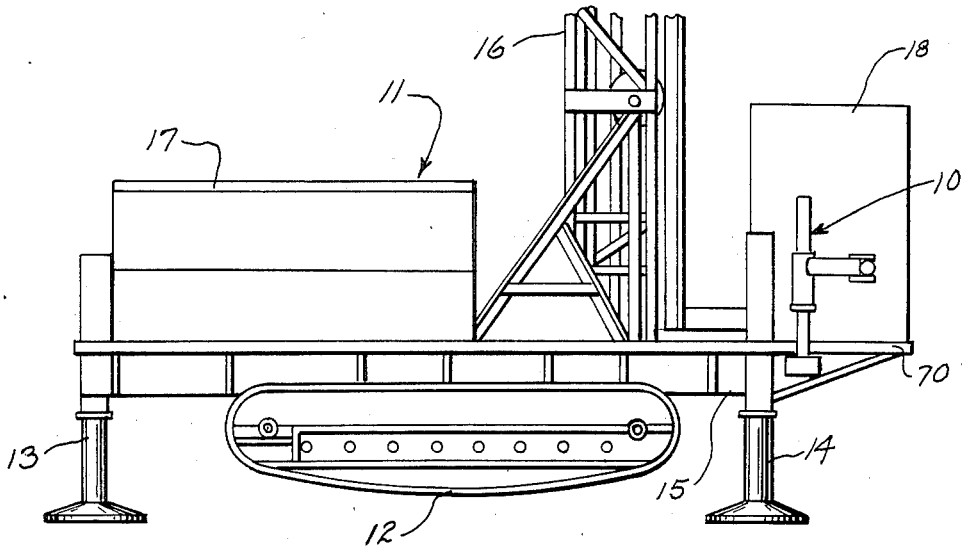
FIG. 1 is a view in side elevation illustrating a typical blast hole drill with the casing tong assembly of this invention.

The casing tong assembly generally 10 is shown in FIG. 1 in conjunction with a typical blast hole drill generally 11 which will include the usual crawler vehicle 12 as well as a pair of front and rear jacks, one of the front jacks being shown at 13 and one of the rear jacks being shown at 14. These jacks are mounted on a usual main frame 15 which supports a drill mast 16, a machinery housing 17 and a cab 18.

Figure 2:
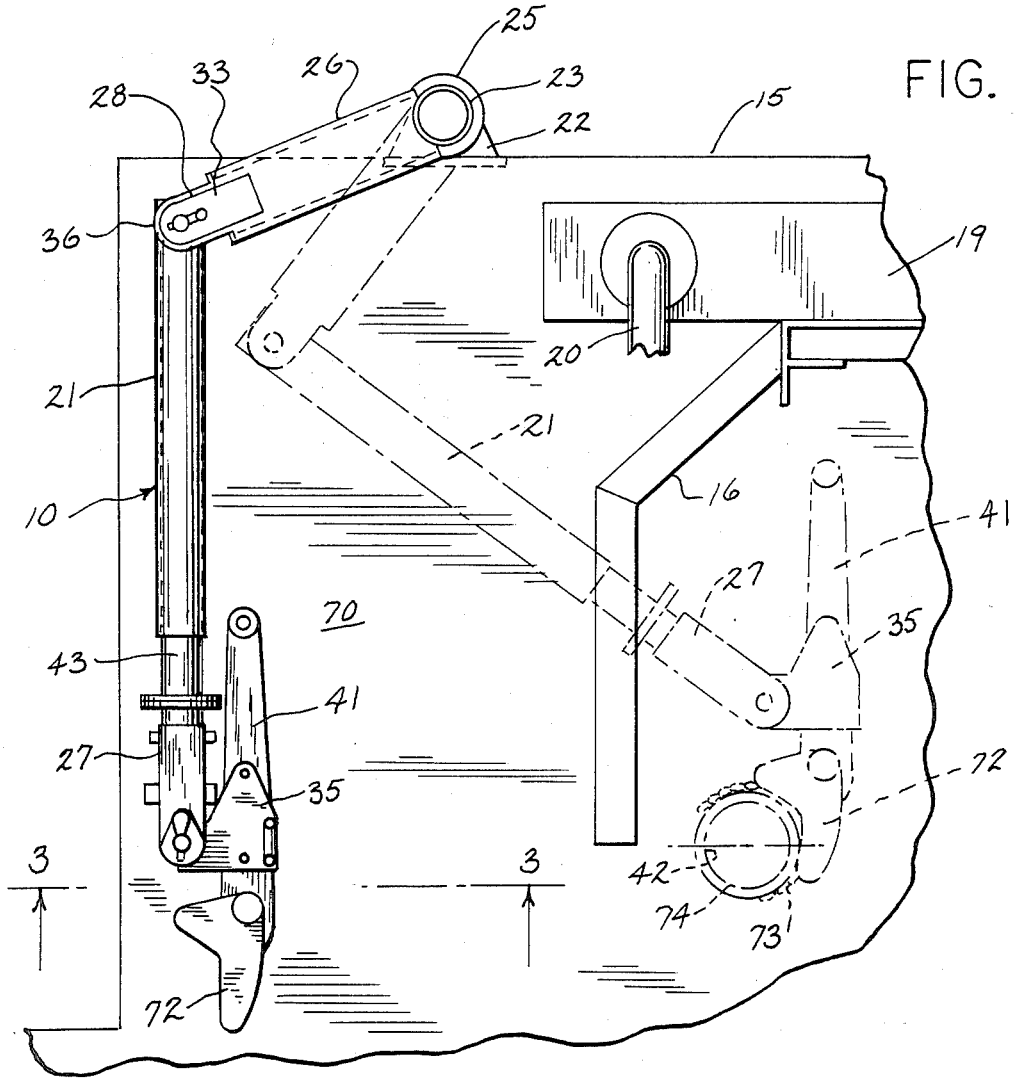
FIG. 2 is a top plan view illustrating the casing tong pivoting arm extending over the main frame deck of the blast hole drill and illustrating its position into the open side of the mast and over the drill hole in phantom lines.

Referring specifically to FIGS. 2 and 3, the casing tong assembly generally 10 extends upwardly from the main frame 15 or deck 70 and includes a slidable sleeve member 25 for movement along an upstanding support column 23. Extending in a transverse manner from the slidable member is a transverse upper arm member 26 to which is attached a pivotable arm 21. A wrist bracket 27 is in turn connected to the arm 21 and a hand bracket 35 is rotatably connected to wrist bracket 27. A typical casing tong 41 having a jaw 72 and a gripping chain 73 to engage the drill pipe 74 is secured to and extends from hand bracket 35 to position jaw 72 in alignment with drill hole 42. As seen in FIG. 2, the usual dust collector 19 with air line 20 is positioned on the main frame 15.

Referring specifically to FIGS. 2, 8 and 9, it will be seen that arm 21 is pivotally attached to the transverse arm member 26 by the pin shaft 36 extending through the plates 33 and 34 which extend outwardly from the transverse member 26. The shaft 36 is connected in a non-rotatable manner to the plate 33 by pin 38 and the cap screw 39. Annular section 49 of the arm portion 21 surrounds the bushing 40 through which the shaft 36 extends.

Referring to FIGS. 4–7, it will be noted that arm portion 43 extends from arm portion 21 and has the flange 46 connected thereto for rotatable connection with the flange 47. Bolts 48 pass through the flange members and secure them in a stationary manner when rotation is not desired. This aspect will be further described during the operation of the casing tong assembly. The bracket wrist portion 27 includes the side plates 51 and 52 as well as the base plate 50, to form in effect a U-shaped housing as seen in FIG. 6. It is attached to the flange 47 as best seen in FIGS. 4 and 5. Positioned in this housing is a second wrist component 64 which includes an annular section 61 for engagement with the bushing 63 whereby this component 64 is pivotally attached between the side plates 51 and 52. Extending from the annular section 61 is the connector portion 62 which in turn is connected to a top plate 59 and a bottom plate 60. As previously described, pin 38 and cap screw 39 provides non-rotatable attachment of the shaft 56 to the side wall 51.

Disposed in the side walls 51 and 52 as well as through the connector portion 62 are a series of holes which are indicated by the letters A–F. These holes are indicated for reference purposes and will be further explained in conjunction with the operation. It should be pointed out that while six holes are provided through the side plates 51 and 52 only four holes are disposed through the connecting portion 62. For purposes of reference, holes indicated with the A–F designation in FIG. 4 are those which are in the side plates 51 and 52 and aligned with each other whereas those designated $A^1$, $B^1$, $C^1$ and $E^1$ in FIG. 7 relate to holes placed through the connecting portion 62. It will be seen that the pin 54 with the spring clip 55 will be placed in the selected holes in a manner to be further described.

The bracket hand 35 is in turn pivotally attached along a vertical axis to the bracket wrist component 27 through connection with the top plate 59 and bottom plate 60. This is provided by the top and bottom plates 35 and 34 of the bracket hand connected to the annular section 65 which will engage the bushing 66. A pin 63 extends through the bushing 66 and is secured by the pin 38 and the cap screw 39. A grease fitting 57 is also provided in the pin 63 as well as in the other pivotal connections for the casing tong assembly as indicated herein. It will be noted that cross supports and reinforcing members 30 are disposed between the plates 33 and 34 and interconnected by spacing member 31, the nut 45 and the bolt 32. A handle screws 44 also connect spacing members 31 to the plates 33. 29 extends from plate 33 for ease of movement of the hand 35.

Referring to FIG. 10, it will be seen that the slidable member 25 will be supported in a height adjustable manner on the column 23 by the flange 67 which will rest upon the pin 68 extending through both the support column 23 and the slidable member 25. A spring clip 69 will provide suitable attachment.

A better understanding of the casing tong pivoting arm will be had by a description of its Operation.

OPERATION

It should be appreciated that during a blast hole drilling operation it is necessary in many instances to drill a hole which is not perpendicular to the plane of the earth's surface. The degree of deviation can range from 0°–30°. It should be further appreciated that the drill pipes will be positioned at the designated angle with respect to the main frame 15 and the casing tongs 10 will be secured to the main frame deck 70.

As a result of this, for the jaw 72 of the casing tong assembly to engage the pipe in the required transverse manner suitable adjustments must be made. These adjustments as well as movement for storage are accorded in the casing tong assembly 10 of this invention wherein a pivoting action is first accorded between arm 26 and arm 21. Angular adjustment is afforded by the wrist-like up and down movement between the bracket wrist 27 and the arm 21. This is provided through the pivoting of wrist component 64 over the shaft 56. With specific reference to the bracket wrist 27, and as earlier indicated, there are a series of openings designated as A–F in the side plates 51 and 52. These openings when utilized in conjunction with the openings designated as A', B', C' and E' in the connector portion 62 will provide an indexing for a designated angular position for the tong 41 and jaw 72. A Table is later presented which shows the position of the pin 54 with respect to the pin holes. As there are only four holes in connector portion 62 some of the holes will be utilized twice. For example, in order to match a mast angle of either 0 degrees or 15 degrees, hole A' would be aligned with hole A in one instance and hole D in another in plates 51 and 52. When an angle of 5° or 25° is to be matched, hole B' will be aligned with holes B or F. Pin holes C' and E' will be aligned with holes C and E so as to provide a match with a mast angle of 10° and 20°, respectively.

It should also be pointed out that in conjunction with the support column 23 there are different levels marked A, B, C, D, E, F and G. The slidable member 25 will be coordinated with the level on the support column in conjunction with a letter designation of the pin indexing means. For example, when the mast angle of 0° is to be matched, the slidable member 25 will be positioned with the pin 68 through the support column hole at the designated A position and the pin 54 positioned through holes A and A'. In contrast when a 30° angle is to be matched the slidable member 25 will be moved so that the flange 67 is adjacent to the level line with the G designation and the pin 68 inserted. The pin 54 will be inserted through the C hole as well as the C' hole.

To better understand the foregoing relationships, the following Table is presented.

TABLE

| PIN HOLES | COLUMN HOLE | MAST ANGLE |
|---|---|---|
| A, A' | A | 0° |

TABLE-continued

| PIN HOLES | COLUMN HOLE | MAST ANGLE |
|---|---|---|
| B, B' | B | 5° |
| C, C' | C | 10° |
| D, A' | D | 15° |
| E, E' | E | 20° |
| F, B' | F | 25° |
| C, G' | G | 30° |

In addition to the foregoing adjustments, there is also a rotational adjustment between the bracket wrist 27 and the arm 21. This is afforded by loosening the bolt 48 and moving the flange 47 which will have appropriate slots 75 as seen in FIG. 11. After the desired rotation is effected so as to match the desired mast angle with the jaw 72 of the tong, the nuts and bolts 48 will then be re-tightened. Additional adjustment is provided by the horizontal pivoting of bracket hand 35 with respect to the wrist 27. The usual chain tightening mechanism 73 will be employed in conjunction with the jaw 72.

The casing tong assembly of this invention affords a multiplicity of adjustments which simulates the movement of the human arm and hand. For example, the support column 23 could be compared to the human body frame with the arm 26 simulating the upper arm and the arm 21 the lower arm. The wrist bracket 27 would simulate the wrist and the hand bracket 25 the hand. Rotation of flanges 46 and 47 simulates elbow rotation. All of these multiple adjustments are afforded in a unit which can be fabricated with readily available component parts which can be assembled without the need of special tooling. The casing tong assembly is easily operated with a minimum amount of effort by the operator which is done in an efficient and expeditious manner as previously indicated.

It is obvious that many modifications can be made to the casing tong apparatus. If only certain desired angular relationships such as for example, the 10° or 30° mast angle match is to be made and then the other pin holes need not be provided in the unit. Similarly, if additional adjustments were to be desired over a larger angle then additional suitable pin hole indexing could be provided. In certain instances the vertical height adjustment of slidable member along column 23 could be eliminated.

We claim:

1. An adjustable casing tong and pivoting arm for disconnecting a drill pipe from a drill string of pipe or a drill bit in a drilling apparatus comprising:

a support column connected to the drilling apparatus;

an arm member supported at one end by said support column for movement in a direction along a longitudinal axis of said support column and for pivotal movement with respect to said column, a first flange member connected to said arm member at the opposite end of said arm member;

a wrist member including a second flange member for selective adjustable rotation with respect to said first flange member;

means to secure said first and second flange members to one another in a selected fixed position;

said wrist member including indexing means having at least one plate member connected to said second flange member and a connector portion pivotally attached to said plate member, openings extending through said plate member and said connector portion and a pin for engagement with selected openings such that said plate member and said connector portion are pivotally attached for indexing said plate member and said connector portion thus providing a pivoting of said connector portion of said wrist member with respect to said arm member; and gripping tong means operatively connected to said connector portion of said wrist member for engaging drill pipe.

2. The adjustable casing tong and pivoting arm of claim 1 wherein said indexing means and said rotation of said first and second flange members provide a pivotal and rotational adjustment of said wrist member so as to match a drill pipe angle in a range of 0° to about 30°.

3. The adjustable casing tong and pivoting arm of claim 1 wherein said gripping tong means includes a bracket hand member pivotally connected to said wrist member.

4. The adjustable casing tong and pivoting arm of claim 1 wherein said arm member is defined by two arm portions, said arm portions being pivotally connected to each other.

5. The adjustable casing tong and pivoting arm of claim 1 wherein said arm member is supported on said support column by pin support means.

6. The adjustable casing tong and pivoting arm of claim 5 wherein said pin support means includes at least two different height adjustments along said longitudinal axis.

7. The adjustable casing tong and pivoting arm of claim 6 wherein said indexing means and said pin support means cooperate to provide adjustment of said gripping tong means through an angle in the range of 0° to about 30°.

8. The adjustable casing tong and pivoting arm of claim 7 wherein said support column is connected to a deck of said drilling apparatus.

9. An adjustable casing tong and pivoting arm for holding sections of a drill string of pipe in a blast hole drill having a tilting mast, the pivoting arm adapted for rotatable connection to a support column, said pivoting arm comprising:

an arm member supported at one end by said support column for movement in a direction along a longitudinal axis of said support column and for pivotal movement with respect to said column, a first flange member connected to said arm member at the opposite end of said arm member;

a wrist member including a second flange member for selective adjustable rotation with respect to said first flange member;

means to secure said first and second flange members to one another in a selected fixed position;

said wrist member including indexing having at least one plate member connected to said second flange member and a connector portion picotally attached to said plate member, openings extending through said plate member and said connection portion and a pin for engagement with selected openings such that said plate member and said connector portion are pivotally attached for indexing said plate member and said connector thus portion providing a pivoting of said connector portion of said wrist member with respect to said arm member; and gripping tong means operatively connected to said connector portion of said wrist member for engaging drill pipe.

10. The adjustable casing tong and pivoting arm of claim 9 wherein said indexing means and said rotation of said first and second flange members provide a pivotal and rotational adjustment of said wrist member so as to match a drill pipe angle in a range of 0° to about 30°.

11. The adjustable casing tong and pivoting arm of claim 9 wherein said gripping tong means includes a bracket hand member pivotally connected to said wrist member.

12. The adjustable casing tong and pivoting arm of claim 9 wherein said arm member is defined by two arm portions, said arm portions being pivotally connected to each other.

13. The adjustable casing tong and pivoting arm of claim 9 wherein said indexing means includes two plate members connected to said second flange member.

14. The adjustable casing tong and pivoting arm of claim 11 wherein said wrist member and said bracket hand member are pivotally connected by a pin shaft and a pin shaft retaining means.

15. The adjustable casing tong and pivoting arm of claim 13 wherein said two plate members and said connector portion have a different number of openings for said pin.

* * * * *

UNITED STATES PATENT AND TRADEMARK OFFICE

CERTIFICATE OF CORRECTION

PATENT NO. : 4,686,873

DATED : August 18, 1987

INVENTOR(S) : Lang et al.

It is certified that error appears in the above-identified patent and that said Letters Patent is hereby corrected as shown below:

| | |
|---|---|
| Column 4, line 1, | Delete "A handle screws" and substitute --Screws-- |
| Column 4, line 2, | Before "29" insert --A handle-- |
| Column 6, line 53, (Claim 9) | After "indexing" insert --means-- |
| Column 6, line 55, (Claim 9) | "picotally" should read --pivotally-- |
| Column 6, line 61, (Claim 9) | "thus portion" should read --portion thus-- |

Signed and Sealed this

Nineteenth Day of April, 1988

*Attest:*

*Attesting Officer*

DONALD J. QUIGG

*Commissioner of Patents and Trademarks*